US006050324A

United States Patent [19]

Jolivet et al.

[11] Patent Number: 6,050,324

[45] Date of Patent: Apr. 18, 2000

[54] CONTINUOUS CASTING MOLD FOR THE VERTICAL CASTING OF METALS

[75] Inventors: Jean-Marc Jolivet, Guenange; Eric Perrin, Metz; Jacques Spiquel, Montigny lés Metz, all of France

[73] Assignees: Societe Anonyme des Forges Et Aciers de Dilling; Ugine Savoie; Ascometal; Sogepass; Sollac; Centre de Recherches Metallurgique, all of, France

[21] Appl. No.: 09/147,007

[22] PCT Filed: Mar. 27, 1997

[86] PCT No.: PCT/FR97/00547

§ 371 Date: Jan. 22, 1999

§ 102(e) Date: Jan. 22, 1999

[87] PCT Pub. No.: WO97/37793

PCT Pub. Date: Oct. 16, 1997

[30] Foreign Application Priority Data

Apr. 5, 1996 [FR] France ..... 96 04305

[51] Int. Cl.[7] ..... B22D 11/041; B22D 11/053; B22D 11/059

[52] U.S. Cl. ..... 164/415; 164/416; 164/418

[58] Field of Search ..... 164/418, 459, 164/444, 487, 416, 415

[56] References Cited

U.S. PATENT DOCUMENTS

| | | | |
|---|---|---|---|
| 3,381,741 | 5/1968 | Gardner . | |
| 3,612,151 | 10/1971 | Harrington et al. | 164/487 |
| 5,325,910 | 7/1994 | Schneider et al. | 164/444 X |

FOREIGN PATENT DOCUMENTS

| | | | |
|---|---|---|---|
| 0 213 049 | 3/1987 | European Pat. Off. . | |
| 0 403 411 | 12/1990 | European Pat. Off. . | |
| 0 620 062 | 10/1994 | European Pat. Off. . | |
| 2704786 | 11/1994 | France . | |
| 5-115961 | 5/1993 | Japan | 164/487 |
| 57 799 | 5/1969 | Luxembourg . | |

*Primary Examiner*—J. Reed Batten, Jr.
*Attorney, Agent, or Firm*—Nixon Peabody LLP; Thomas W. Cole

[57] ABSTRACT

The mold comprises a tubular metal component (4), made of copper or a copper alloy, cooled by water circulation against its external wall and intended to ensure that the cast metal undergoes peripheral solidification on contact with its internal wall, and an uncooled feed head (9) made of a thermally insulating refractory, intended to contain cast metal in the liquid state and sitting on top of the cooled metal component (4) and defining with it a continuous sizing passage for the cast metal. A horizontal metal annulus (16) cooled by internal circulation is added between the feed head (9) and the tubular component (4) and aligned with the internal wall of the latter.

8 Claims, 1 Drawing Sheet

CONTINUOUS CASTING MOLD FOR THE VERTICAL CASTING OF METALS

FIELD OF THE INVENTION

The present invention relates to the continuous casting of metals, especially of steel. It relates more specifically to the so-called technique of "vertical hot-top continuous casting".

PRIOR ART

The first articles on this technique seem already to have been published toward the end of the sixties, a good example of which is document FR-A-2,000,365. Since then, it has become distinguished from conventional vertical continuous casting, very widely practiced at the present time throughout the world, essentially by the fact that sitting on top of the "active" component of the mold, namely the vigorously cooled tubular metal component in which the desired solidification of the cast metal starts and grows, is a thermally insulating feed head intended to contain, in the liquid state, the molten metal delivered by a tundish located above it.

This "active" component is conventionally a tube made from a single piece (for casting billets or blooms) or made from plates joined together (for casting slabs or large blooms). It is made of copper, or a copper alloy, and vigorously cooled by intense circulation of water against its external wall so as to be able to extract a sufficient heat flux to ensure that the molten metal solidifies on contact with its internal wall.

These two contiguous components define a continuous sizing passage for the cast metal which enters it in the molten state via the top and leaves it via the bottom in the form of a solid shell deriving from the peripheral solidification of the cast metal on contact with the cold wall of the mold body and which contains a still-liquid core. Solidification then continues to its conclusion in the lower part of the casting machine by means of spray units.

The basic advantage sought in vertical hot-top continuous casting resides in the fact that it is thus possible for the free surface (the "meniscus") of the metal poured into the mold, which free surface then lies within the refractory feed head, to be distanced from the point where the cast metal on first coming into contact with the cold wall of the mold body necessarily starts to solidify, i.e. in the region of the edge of the upper end of the copper component.

Thus, the intention is to cast semi-finished products of superior metallurgical quality continuously at high extraction rates, which are even higher than in conventional continuous casting, since the solidification process is then initiated in a hydrodynamically calm environment, any turbulence, especially that caused by the influx of molten metal, remaining confined within the buffer volume provided by the refractory feed head.

Moreover, this technique has no significant drawbacks with respect to conventional continuous casting, from which it may be seen as a development, and therefore involves no major technological step. It is possible, without any particular difficulty, to convert a conventional continuous casting machine into a hot-top continuous casting machine since in particular the tundish, although placed at a short distance above it, does not remain rigidly connected to the mold. However, although the first publications on the hot-top continuous casting of steel are contemporaneous with the introduction on an industrial scale of vertical continuous casting, which has undergone the extraordinary amount of development which is known about (more than 80% of steel production world-wide is currently produced by continuous casting), at the present time vertical hot-top continuous casting still remains in the research stage of the process of applying the technology on an industrial scale.

Trials performed by the Applicants have exposed a major problem which may explain this lack of acceptance from an industrial standpoint, namely the instability over time of the geometry at the "cooled copper component/refractory feed head" interface. This is because this geometry suffers because of deformation of the upper end of the cooled component.

In conventional vertical continuous casting, such deformation is caused by adventitious rises of the liquid metal which may be as high as to result in its spilling over out of the mold. This rarely has any effect on the continuation of the casting operation. In contrast, in hot-top continuous casting, because the meniscus is shifted upstream of the cooled component, the situation is permanently similar to that of the "spill-over" type. The deformation of the upper end of the copper component, at the point precisely where the desired solidification of the cast metal is initiated, then becomes unacceptable (infiltration of molten metal under the feed head, misalignment with the feed head, etc.).

SUMMARY OF THE INVENTION

The object of the invention is specifically to avoid any thermomechanical deformation of the upper end of the cooled copper component during casting.

For this purpose, the subject of the invention is a mold for the vertical hot-top continuous casting of metals, in particular of steel, comprising a cooled tubular metal component (made of copper or a copper alloy), especially cooled by water circulation against its external wall, and is intended to ensure that the cast metal undergoes peripheral solidification on contact with its internal wall, and an uncooled feed head made of a thermally insulating refractory sitting on top of the cooled metal component, intended to contain molten metal and defining with it a continuous sizing passage for the cast metal, which mold is distinguished by the fact that a metal annulus, cooled by annular circulation of a coolant, is added between the tubular metal component and the thermally insulating feed head, the internal wall of said annulus being solid and aligned with said tubular metal component without any break between them so as to satisfy the continuous nature of the passage offered to the cast metal by the mold.

Preferably, this annulus is made of the same metal as the cooled tubular component, i.e. made of copper or a copper alloy.

Also preferably, this annulus is removably mounted so that it can be easily replaced.

According to an advantageous variant of the invention, the annulus includes an internal cooling circuit consisting of a chamber for the annular circulation of a coolant, this chamber going along the internal wall of the annulus around the perimeter of the mold, and preferably in the immediate vicinity of this wall.

As will doubtless already have been understood, the invention therefore consists in its essential characteristics in inserting, between the mold tube and the refractory feed head, a cold body—the annulus—which in fact constitutes an extension of the main tubular component, it being made of the same material, but having its own cooling circuit, and its relatively small height (compared with that of the tube) allows much greater cooling effectiveness than could at best be provided by the cooling system for the tube, in the region of its ends, especially the edge of its upper end facing the feed head. In order to be more specific, the tube of a continuous casting mold is usually from 0.7 to 1.0 meter in length, whereas the annulus according to the invention is, for example, from 4 to 10 centimeters in height.

From the standpoint of the casting process, this amounts to shifting the solidification-onset plane to the level of the upper edge of the annulus. In other words, in order to fulfill the solidification-onset function, the cooled tubular component of the mold substitutes for an autonomous annulus, which is preferably removable and is also cooled, but whose cooling effect at its ends is, of course, more effective because of its small height compared with that of the main tubular component of the mold and therefore there is the possibility of incorporating therein a sheet of cooling water circulating horizontally and no longer vertically.

In this regard, in fact, the technological constraints of the cooling circuit (the water jacket connecting two chambers at its ends), which are associated with the need to ensure as a matter of priority that its entire working height is intensely cooled in order to extract therefrom the considerable overall heat flux imposed by the progress of the peripheral solidification of the cast metal which travels the entire length of it, reach, in return, their limit in preventing deformation of the ends of the tube if the temperature at these points rises to the level of that of the molten steel.

The invention overcomes this obstacle by means of an additional body which is also intensely cooled but has a small height so as to be able to incorporate therein a horizontal circulation of the coolant and thus to ensure effective cooling both of its own upper edge, in contact with the refractory feed head in order to prevent it from deforming at this point in contact with the molten metal, and of the upper end of the tube of the mold with which it is in intimate contact via its lower face.

DESCRIPTION OF THE DRAWINGS

The invention will be clearly understood and other aspects and advantages will be more clearly apparent in light of the following description given by way of an embodiment with reference to the appended single plate of drawings, in which.

In the figures, the same components are denoted by identical reference numbers.

Figure 1:
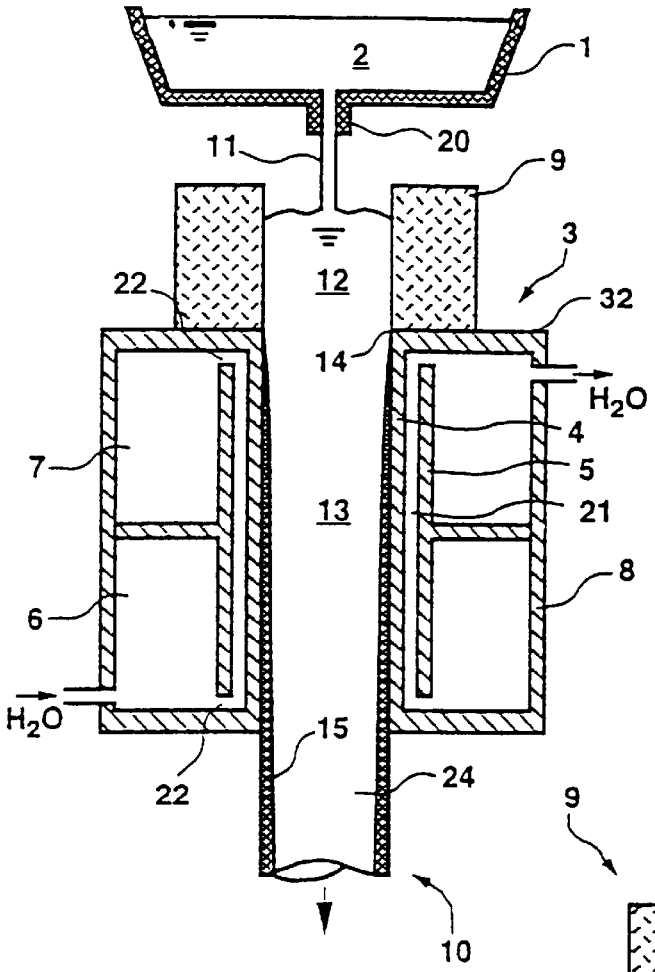
FIG. 1 PRIOR ART
FIG. 1 shows diagrammatically, in vertical section, the upper part of a machine for the vertical hot-top continuous casting of steel according to the usual design of the known prior art.

Referring to the general view in FIG. 1, it may be seen that the upper part of a machine for the vertical hot-top continuous casting of steel consists, in the direction of extraction of the metal to be produced, i.e. from the top downward in the figure, of a tundish 1 containing a bath of molten metal 2 which it delivers to a mold 3 (or several molds 3) placed beneath it by means of an outlet orifice (or several outlet orifices) extended by a guide nozzle 20.

As may be seen, the mold comprises a tubular copper component 4 which is vigorously cooled by the circulation of water over the length of its external face. Conventionally, a steel liner 5 is provided for this purpose, around and at a short distance from the tube 4, in order to channel a vertical sheet of circulating water 21. The liner 5 has, at its ends, openings 22 which bring the sheet of water 21 into communication with an inlet chamber 6 and with a discharge chamber 7, these chambers being delimited by a casing 8 surrounding the liner 5 at some distance therefrom.

Sitting on top of the internal tubular component 4 is a feed head 9 made of an uncooled refractory, the internal wall of which is preferably aligned with that of the body 4 (and in any case, not set back).

In the context of the casting process, the "cooled metal component 4 on which sits the insulating refractory feed head 9" arrangement defines a sizing passage for the cast metal, the upper part 12 of which passage, within the feed head, constitutes a buffer region for confining the hydrodynamic perturbations caused by the arrival of the stream 11 of molten metal into the mold and the lower part 13 of which passage, which extends it, is a region for solidification of the cast metal.

This solidification, as will be seen, begins right from the first contact of the cast steel with the internal wall of the cooled copper body 4, namely along the upper edge 14 of this wall, and continues downstream, forming a solid shell 15 which grows in thickness from the periphery towards the center. On leaving the mold, the shell 15, which has a thickness of slightly more than one centimeter, is strong enough to withstand the ferrostatic pressure of the still-liquid core 24 and continues its centripetal growth until the cast semi-finished product 10 has completely solidified under the effect of the water spray units, not shown, which are located in the bottom half of the machine. Once the semi-finished product has completely solidified, it is cut into portions of the desired length (billets, blooms or slabs, depending on the format of the cast section) and these portions are then available for subsequent forming operations (rolling, etc.).

Figure 2:
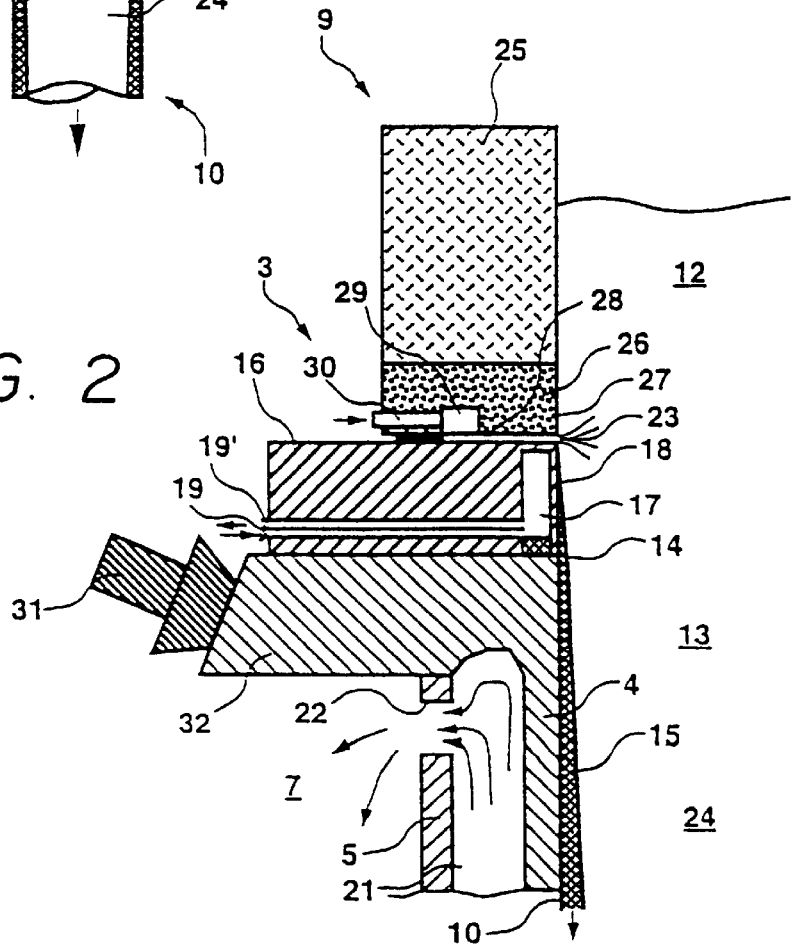
FIG. 2 is an enlarged partial view of the top part of a machine of the aforementioned type but showing in detail the design according to the invention, according to the fullest embodiment.

Referring now more particularly to FIG. 2, it may be seen that, in accordance with the invention, an annulus 16 sits on top of the tubular component 4, this annulus extending the latter and also being made of a copper alloy and also cooled, but by means of its own cooling system. In the example described, the latter consists of a chamber 17 going along the solid internal wall 18 of the annulus and at a short distance therefrom. This chamber is circular in form and has its inlet and outlet close to each other on either side of a partition which closes off the chamber. Thus, a cooling circuit in the form of a horizontal annulus is produced, in which an annular and therefore horizontal circulation of coolant (for example, water) surrounding the cast product is established.

In the figure, only the cooling-water inlet nozzle 19 and outlet nozzle 19' connecting the circular chamber 17 to the outside have been illustrated.

The cooled annulus 16 is faced on its base so as to mate well with the upper surface of the component 4 on which it rests and thus to avoid any risk of infiltration of molten metal.

The cooled metal assembly, formed by the annulus 16 and the tubular component 4, constitutes the actual "active" part of the mold. From the standpoint of the cast metal, these two components, which are juxtaposed without any break between them, act as a single component, since it is there that the solidification of the cast metal starts and continues to grow as the cast product 15 advances downward inside this assembly. The plane of onset of this solidification is no longer the plane passing through the upper edge 14 of the component 4 but that passing through the upper edge 23 of the annulus 16.

Sitting on top of this assembly 16-4 is the thermally insulating feed head 9, as seen previously.

DESCRIPTION OF THE PREFERRED EMBODIMENTS

In accordance with a preferred embodiment of the invention, this feed head 9 itself is also formed by two superposed separate components:

an upper bush 25 made of a refractory chosen for its thermal insulation properties, since it has to prevent any premature spurious solidification of the cast metal in the turbulence region 12. The material of choice will be a fibrous refractory, for example the material sold under the name A 120K by the French company KAPYROK; and a lower component—the ring 26—made of a refractory chosen for its good mechanical strength since, in the vicinity of the crystallizer 4-16, the mechanical erosion by the upper tip of the solid shell 15 on the edge 23 while the whole assembly undergoes the usual vertical oscillatory motion necessary for the success of the casting run, and the thermomechanical stresses of a machine operating in thermal cycles imposed by the necessarily sequential nature of the casting process must be resisted as well as possible. A material such as SiAlON (Sialon), preferably doped with boron nitride, will be perfectly suitable.

Preferably, a circuit for injecting a waste inert gas (for example argon) is provided between the feed head 9 and the metal assembly 16-4.

This circuit comprises an annular slit 28 made at the feed head 9/metal assembly 16-4 interface and emerging at one end around the internal perimeter of the mold and connected at its other end to a plenum chamber 29 supplied with argon via a calibrated nozzle 30 which itself is connected to a source of pressurized argon, not illustrated.

The benefit of a feed head made as two superposed parts resides in the fact that it can improve the mechanical strength of the lower part subjected to the erosion caused by the "to-and-fro" motion of the adjacent solidified tip of the cast metal, this motion being imposed by the vertical oscillations of the mold.

On the other hand, this strong lower ring 26 is inevitably less heat insulating than the top part. The cast metal can therefore form a film of premature spurious solidification at the point of contact between its aligned internal wall 27 and that of the cooled annulus 16. This film is a major source of heterogeneity with regard to the controlled solidification process in the cooled metal assembly 16-4. This is the reason why, according to an advantageous embodiment of the invention and as already known elsewhere (FR-A-93 03871), a curtain of argon is blown in at the base of the feed head 9 for the purpose of breaking the film of spurious solidification formed on the ring 26 and of allowing the cast metal to start to solidify in a uniform and sharp manner on contact with the cooled annulus 16.

It will have been understood that a key advantage of the invention resides in the fact that, since the most stressed upper part of the mold is made in the form of an additional piece (the annulus 16), this part may be easily replaced by a new piece as required and under the economic conditions compatible with industrial implementation of hot-top continuous casting, something which is not the case if the internal tubular component 4 has to be replaced.

In accordance with another advantageous embodiment, the tendency for the shell 15 to stick against the wall of the mold is reduced by adding a known lubrication, achieved by injecting a lubricant through the copper component 4 (see FR-A-91 01551) and by vibrating this component using an ultrasonic transducer applied to the free end of the upper return 32 of the cooled component 4. This transducer may be of the "piezoelectric" type.

It is not necessary for the direction of application of the ultrasound to be oblique (cf. FIG. 2). Nevertheless, oblique application has the advantage of combining a vertical vibratory effect with a horizontal vibratory effect, both of which contribute to reducing the friction between the cast product 10 in the mold.

For more details, reference may be made to document FR-A-89 07839.

It goes without saying that the invention is not limited to the example described but extends to many variants or equivalents as long as its essential characteristics given in the appended claims are respected.

In particular, the invention applies to long products as well as to flat products. Thus, the terms used above, such as "annulus", "annular" or "ring", although they suggest a circular shape, must be understood from a more general standpoint as encompassing molds whose cooled internal tubular component consists of assembled plates (molds for a continuous casting of slabs or large blooms, for example).

Likewise, the invention applies to the continuous casting not only of steel but of any other continuously castable metal, especially metals having a lower melting point than steel, such as aluminum or copper.

What is claimed is:

1. A continuous-casting mold for the vertical hot-top continuous casting of metals, comprising a cooled tubular metal component intended to ensure that the cast metal undergoes peripheral solidification on contact with its internal wall, an uncooled feed head made of a thermally insulating refractory material sitting on top of the cooled metal component, intended to contain cast metal in the liquid state and defining with it a continuous sizing passage for the cast metal, which mold is characterized in a metal said annulus, cooled by annular internal circulation of a coolant, is added between the cooled tubular metal component and the thermally insulating feed head, the internal wall of the said annulus is solid and aligned with the said metal tubular component without any discontinuity between them so as to satisfy the continuous nature of the passage offered to the cast metal by the mold.

2. The mold as claimed in claim 1, wherein the cooled metal annulus is made of the same metal as the tubular metal component.

3. The mold as claimed in claim 1, wherein the cooled metal annulus has a height of between 4 and 10 centimeters approximately.

4. The mold as claimed in claim 1, wherein said annulus is removably mounted on the tubular metal component.

5. The mold as claimed in claim 1, wherein the annulus includes an internal cooling circuit consisting of a chamber for the horizontal circulation of the coolant, this chamber going along the internal wall of the annulus around the perimeter of the mold.

6. The mold as claimed in claim 1, wherein the refractory feed head consists of two superposed separate components -an upper bush made of a refractory having good thermal insulation properties and a lower ring made of a refractory having good mechanical strength.

7. The mold as claimed in claim 1, wherein it includes a circuit for injecting an inert gas around the internal perimeter of the mold between the feed head and the annulus.

8. The mold as claimed in claim 1, wherein it is provided with an ultrasonic transducer applied to the end of the upper return of the tubular metal component and intended to make the mold undergo vibratory motion.

* * * * *